US005088141A

United States Patent [19]

Meyer et al.

[11] Patent Number: 5,088,141

[45] Date of Patent: Feb. 18, 1992

[54] THERAPEUTIC PILLOW

[75] Inventors: Randall A. Meyer, Minneapolis; Philip H. Mattison, Forest Lake, both of Minn.

[73] Assignee: Core Products International, Inc., St. Paul, Minn.

[21] Appl. No.: 696,115

[22] Filed: May 6, 1991

[51] Int. Cl.[5] ..... A47G 9/00

[52] U.S. Cl. ..... 5/464; 5/448

[58] Field of Search ..... 5/434-437, 5/441, 442

[56] References Cited

U.S. PATENT DOCUMENTS

| | | | |
|---|---|---|---|
| 1,212,515 | 1/1917 | Leavitt | 5/436 |
| 1,285,421 | 11/1918 | Seidler | 5/436 |
| 2,880,428 | 4/1959 | Forsland . | |
| 2,940,088 | 6/1960 | Boos | 5/436 |
| 2,956,291 | 10/1960 | Hauptman . | |
| 3,400,413 | 9/1968 | LaGrossa . | |
| 3,829,917 | 8/1974 | Delaittre . | |
| 3,848,281 | 11/1974 | Mathews . | |
| 4,320,543 | 3/1982 | Dixon . | |
| 4,375,112 | 3/1983 | Leonhart . | |
| 4,468,824 | 9/1984 | O'Hanlan . | |
| 4,528,705 | 7/1985 | Greenawalt . | |
| 4,574,411 | 3/1986 | Yagi . | |
| 4,748,702 | 6/1988 | Sandler . | |
| 4,788,728 | 12/1988 | Lake | 5/436 X |
| 4,908,893 | 3/1990 | Smit | 5/434 |
| 4,908,894 | 3/1990 | Sanders | 5/442 X |

FOREIGN PATENT DOCUMENTS

| | | | |
|---|---|---|---|
| 8101524 | 11/1981 | Fed. Rep. of Germany | 5/436 |

*Primary Examiner*—Michael F. Trettel

*Attorney, Agent, or Firm*—Haugen and Nikolai

[57] ABSTRACT

A therapeutic pillow for supporting the neck and head of the user is described. The pillow has a generally rectangular shape. However, all of the four sides are concaved rather than straight. The radius of curvature is selected to approximate the position of the shoulders of the user when the user lies on his or her back in an at rest position. The pillow also has an irregular-shaped central hollow. This configuration yields four lobes each of which is designed to support the neck and head in a different way.

1 Claim, 1 Drawing Sheet

THERAPEUTIC PILLOW

BACKGROUND OF THE INVENTION

This invention relates to pillows and, more particularly, to a pillow that is therapeutically designed to provide proper orientation of the head, neck and shoulders of the user during sleep. The pillow of the present invention is uniquely designed to provide such support if the user is lying on his or her back, right side or left side. In that the pillow is not perfectly symmetrical in its design, the present invention provides the user with a variety of optional orientations to promote increased comfort and proper support independent of the physical dimensions of the user's head, neck and shoulders.

DESCRIPTION OF THE PRIOR ART

The standard rectangular pillow has been in common use for many years. However, this type of pillow suffers from serious draw backs in that they provide relatively poor sleeping support to the user. The support that is provided is generally uneven and can result in serious discomfort and exacerbation of preexisting injuries. Poor support during sleep can cause head ache, neck ache, back ache and other muscular discomfort.

To address the problems inherent in standard rectangular solid-bodied pillows, others have attempted to come up with pillows which solve these and other problems. One type of pillow that has resulted in some success in the marketplace is shown in U.S. Pat. No. 3,829,917 to Earl W. DeLaittre. This patent issued on Aug. 20, 1974. The pillow disclosed in this patent comprises an integral generally elongated pad of resilient foamrubber like material having an upper face with a pair of generally parallel, user supporting lobes extending the length of the pad and separated by a trough. According to the patent, one lobe is positioned to support the neck region of the user and the second lobe is to support the upper head region when the body of the user lies in a generally transverse orientation to the elongated dimension of the pad. The pillow is provided with a lower, generally flat face which, in association with the pair of lobes, achieves a conventional pillow appearance when fitted with a pillow case. Both lobes are generally convex in cross section extend from the lower face to the trough, merging smoothly with the trough. When the head and neck of the user are placed on the upper surface, the pillow generates a restoring force which is applied to the head and neck of the user to stretch the neck muscles of the user and induce a more relaxed sleeping posture.

In addition to the trough-type structure reflected in the DeLaittre patent discussed above, other pillow designers have adopted designs which include a central section incorporating a hollow aperture. Such designs are shown, for example, in U.S. Pat. No. 4,788,728 to Lake which issued on Dec. 6, 1988 and U.S. Pat. No. 3,400,413 which issued on Sept. 10, 1968 to E. LaGrossa. The pillow disclosed in the Lake '728 patent is generally rectangular in configuration and has a central hollow which opens to the top surface of the pillow. The hollow has an essentially straight forward edge and substantially straight opposite side edges 36 that meet the forward edge to its substantially square corners. Arcuate edge portions connect the side edges to the rear edge. The rear edge of the hollow has a central portion that curves toward and then away from the forward edge to form and forwardly extending projection. The patent recites that this projection is an integral part of the rear portion and is critical to the effectiveness of the design.

The LaGrossa patent also shows a rectangular-shaped pillow having a rectangular shaped central hollow. The hollow is centrally located on the pillow between the front and rear edges.

A serious problem with pillows such as those shown in the LaGrossa and Lake patents is that they are either (a) symmetrical in design affording no differentiation for increased comfort; or (b) designed to be used in only one particular way independent of the body characteristics and the needs of the user.

The present invention is intended to overcome these deficiencies. The present invention provides a pillow which does not have a rectangular shape yet would appear to have such a shape when fitted with a pillow case. This feature is important from an aesthetic standpoint. This appearance is achieved by providing a pillow which has four corners, but concaved edges which are intended to conform with the natural orientation of the shoulders of the user when the user lies on his or her back in a relaxed fashion with the head placed on the pillow.

The pillow of the present invention also includes a central hollow which is positioned closer to the front edge of the pillow than the back edge of the pillow. The hollow can be characterized as having an arcuate base ridge which runs parallel to and has the same radius of curvature as the front edge of the pillow. The hollow is further defined by an arcuate ridge or arch which extends rearwardly from the opposite ends of the base ridge. When constructed in accordance with the invention, this results in a pillow having four separate lobes, each having a different size and shape. The user can, of course, pick the orientation of the pillow which best suits the user. Finally, each of the four arcuate edges are thicker in their center and thinner near their ends where the corners are formed.

A primary object of the present invention is to provide a contour pillow which enhances comfort and reduces pressure on the head, neck, and shoulders of the user.

A further important object of the present invention is to provide an extremely simple and inexpensive pillow which provides proper support and at the same time, when covered by a pillow case, does not appear to be materially different, from an aesthetic standpoint from conventional pillows.

Another important object of the present invention is to provide a pillow which provides the user with a choice of orientation to maximize the user's comfort and the support provided by the pillow to users having different body characteristics, dimensions, and types.

These and other objects and advantages will become more readily apparent as the details, construction and use of the invention are more specifically hereinafter described and claimed, reference being had to the accompanying drawings forming a part hereof, wherein like numerals refer to like parts throughout.

DETAILED DESCRIPTION OF THE PREFERRED EMBODIMENT

Figure 1:
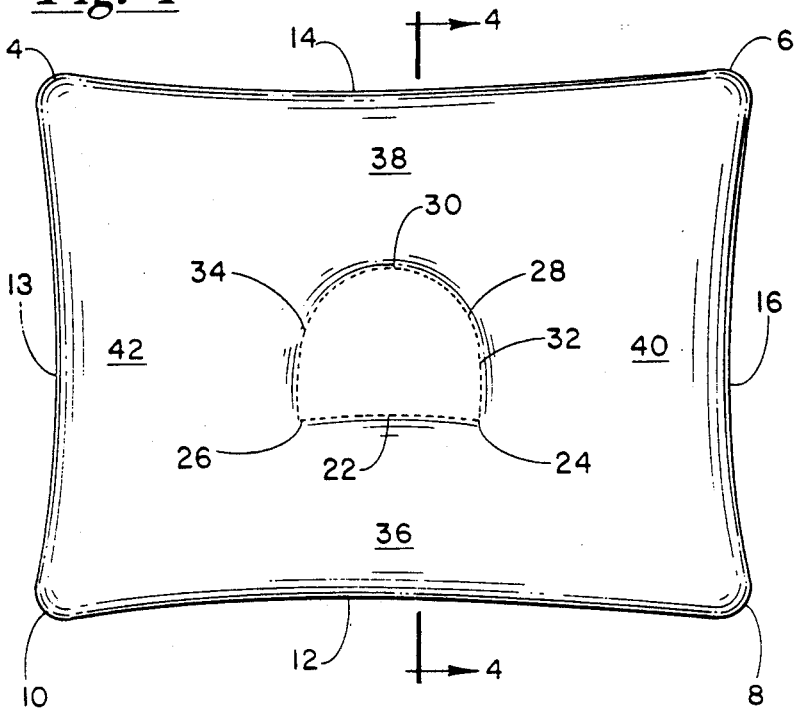
FIG. 1 is a plane view of a pillow of the present invention.
Figure 3:
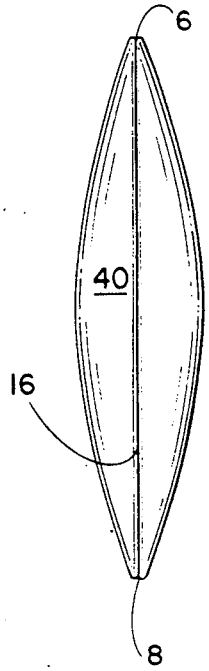
FIG. 3 is a side view of the present invention.
Figure 2:
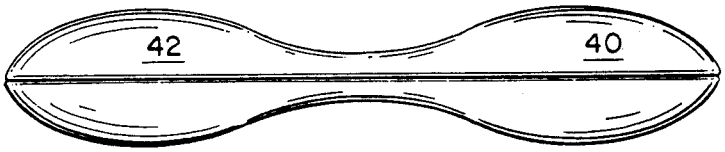
FIG. 2 is a front view of the present invention.

As shown in FIG. 1, the pillow 2 of the present invention has four corners 4, 6, 8 and 10. A front edge 12 extends between corners 8 and 10. A rear edge 14 extends between corners 4 and 6. A right edge 16 extends between corners 6 and 8 and a left edge 18 extends between corners 4 and 10. Edges 16 and 18 are of the same length. Edges 12 and 14 can be of the same length or shorter. None of these four edges are straight. Instead, each of the four edges is scalloped in an arcuate concaved configuration.

FIG. 1 also shows a hollow 20. Hollow 20 has a concaved base ridge 22 terminating in ends. Base ridge 22 runs generally parallel to front edge 12 and has generally the same radius of curvature. This radius of curvature is intended to conform to the natural repose of the user's shoulders when the user is in an at rest, relaxed position on his back. Projecting from ends 24 and 26 toward the rear edge 14 is an arch 28. The arch has an apex 30, and opposite sides 32 and 34 extending from the apex to the corresponding edge 24 and 26 respectively of the base 22. The apex 30 of the arch 28 is further from the rear edge 14 than the base 22 is from the front edge 12. End 26 is approximately the same distance from edge 18 as end 24 is from edge 26.

Lying between each edge 12–18 and the hollow 20 is a lobe. These lobes are designated as 36, 38, 40, and 42 in the drawings.

Figure 4:
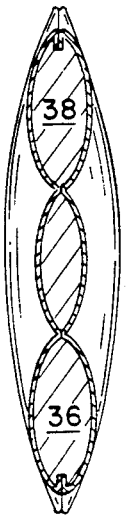
FIG. 4 is a cross section through line 4—4 of FIG. 1.

It is important to note that lobes 36 and 38 are not symmetrical. As shown in FIG. 4, both have approximately the same height. Yet, lobe 36 is more round and less long than lobe 38. Lobe 38 has more of an elongated oval shape when viewed in cross section. While lobes 40 and 42 may appear to be symmetrical from FIG. 1, from the description provided above, it is clear that they are the mirror image of each other and support the head, neck and shoulders quite differently.

From the details of construction recited above, it should also be apparent that the thickness of each lobe along its edge 12, 14, 16, or 18 is greater at the mid-point of that edge than it is near the corners. The pillow 2 is, of course, substantially thinner in the area of hollow 20 than it is in the thickest part of any of the four lobes.

With the description of the pillow provided above clearly in mind, various uses of the pillow will now be described beginning with the user lying flat on his back. Shorter adults and children will most likely achieve greatest comfort by lying in the position wherein the neck is supported by the lobe 36 and the back of the head is in the hollow 20. This is because the length from the top of their shoulders to the back of the head is shorter. The shorter lobe 36 provides excellent support to the neck. Taller people, on the other hand, will probably prefer that the neck be supported by the lobe 38 with the back of the head in hollow 20. The additional length of the lobe 38 will provide greater support throughout the entire length of their necks.

Often times, people will find it more restful to lie on their sides as opposed to their backs. This, of course, is possible with the neck supported either by lobe 36 or lobe 38. However, the shape of the hollow is well suited to support the head in a position facing the edge 14 with the neck supported by either lobe 40 or lobe 42 if the user so desires. For example, if the user prefers lying on his or her right side, the neck could be supported by the lobe 42 with the head facing edge 14. Likewise, if a person prefers to lie on his or her left side, the neck could be support by the lobe 40 with the head facing edge 14. Such uses of the present invention may be especially beneficial to those who are ill, elderly, infirm or handicapped.

While several ways of using the subject pillow have been described, the unique nature of its design provides the user with many other options to achieve better comfort and support. The shape allows the head to be tilted upward or downward as desired. The design also permits the pillow to be positioned in various ways to yield differing degrees of support. All of this should be apparent to one skilled in the art from the detailed description of the device provided above. Those skilled in the art will also recognize that the four lobes be made with varying degrees of firmness depending upon the type and quantity of fill placed in each lobe.

What is claimed is:

1. A head and neck supporting pillowing having:

a. a first concaved edge having a first end and a second end;

b. a second concaved edge having a first end and a second end;

c. a third concave edge having a first end and a second end, said first and second ends of said third concaved edge respectively joined to the first ends of the first and second concaved edges to form first and second corners;

d. a fourth concaved edge having first and second ends, said first and second ends of said fourth concaved edge respectively joined to the second end of the first and second concaved edges to form third and fourth corners;

e. a hollow defined by an arcuate base having a pair of ends, generally the same radius of curvature as the first concaved edge and an orientation parallel to said first concaved edge, and an arch projecting from the ends of said base toward said second concaved edge, said arch having an apex, said apex being the point on the arch closest to said second concaved edge, said hollow positioned so said base is closer to the first concaved edge than said apex is to said second concaved edge; and f. a separate support lobe associated with each of said four concaved edges defined by said concaved edges and said hollow.

* * * * *